US005192367A

United States Patent [19]

Hofmann

[11] Patent Number: 5,192,367

[45] Date of Patent: Mar. 9, 1993

[54] DRIVE MECHANISM FOR A PRINTED SHEET VARNISHING DEVICE OF A PRINTING MACHINE

[75] Inventor: Günther Hofmann, Walldorf, Fed. Rep. of Germany

[73] Assignee: Heidelberger Druckmaschinen AG, Heidelberg, Fed. Rep. of Germany

[21] Appl. No.: 693,860

[22] Filed: Apr. 29, 1991

[30] Foreign Application Priority Data

Apr. 27, 1990 [DE] Fed. Rep. of Germany ..... 4013462

[51] Int. Cl.[5] ..... B05C 1/02; B05C 1/10

[52] U.S. Cl. ..... 118/46; 118/249; 118/261; 192/84 PM; 101/350

[58] Field of Search ..... 118/46, 203, 239, 248, 118/249, 262; 310/75 D, 82, 103; 192/84 PM; 101/350

[56] References Cited

U.S. PATENT DOCUMENTS

| | | | |
|---|---|---|---|
| 2,283,003 | 5/1942 | Frostad et al. | 101/182 |
| 2,406,928 | 9/1946 | Taylor et al. | 101/350 |
| 2,642,740 | 6/1953 | Stephenson et al. | 192/84 PM |
| 3,085,407 | 4/1963 | Tomlinson | 192/84 PM |
| 3,196,787 | 7/1965 | Finke | 101/182 |
| 3,636,277 | 1/1972 | Pöhler | 192/84 PM |
| 3,860,064 | 1/1975 | Murphy | 192/84 PM |
| 4,065,234 | 12/1977 | Yoshiyuki et al. | 192/84 PM |
| 4,115,040 | 9/1978 | Knorr | 192/84 PM |
| 4,183,296 | 1/1980 | Rambausek | 101/181 |
| 4,218,972 | 8/1980 | Fujishiro | 101/180 |
| 4,369,734 | 1/1983 | Preuss | 118/203 |
| 4,397,236 | 8/1983 | Greiner et al. | 101/350 |
| 4,399,767 | 8/1983 | Simeth | 118/236 |
| 4,453,464 | 6/1984 | Weis | 101/216 |
| 4,480,548 | 11/1984 | Rebel et al. | 101/364 |
| 4,495,863 | 1/1985 | Depot et al. | 101/350 |
| 4,497,250 | 2/1985 | Dressler | 101/350 |
| 4,527,477 | 7/1985 | Galster et al. | 101/365 |
| 4,567,823 | 2/1986 | Hummel et al. | 101/352 |
| 4,706,601 | 11/1987 | Jahn | 118/46 |
| 4,813,356 | 3/1989 | Abendroth et al. | 101/415.1 |
| 4,836,112 | 6/1989 | Moore | 101/248 |
| 4,899,655 | 2/1990 | Seo et al. | 101/181 |
| 5,010,820 | 4/1991 | Löffler | 101/484 |

FOREIGN PATENT DOCUMENTS

| | | | |
|---|---|---|---|
| 3638469 | 10/1987 | Fed. Rep. of Germany . | |
| 86336 | 9/1957 | Netherlands | 192/84 PM |

*Primary Examiner*—W. Gary Jones
*Assistant Examiner*—Todd J. Burns
*Attorney, Agent, or Firm*—Nils H. Ljungman and Associates

[57] ABSTRACT

A device for varnishing printed sheets in a printing machine. The varnishing device includes a varnish pan, a varnish dipping roller and a metering roller for transferring varnish onto a varnishing cylinder. The dipping roller and the metering roller have a drive that can be connected to the printing machine drive mechanism by an overrunning clutch. The printing machine also includes an auxiliary motor by which the dipping roller and the metering roller can be driven when the printing machine is at a standstill. A torque transmission device, for driving the dipping roller and the metering roller, is also provided. The torque transmission device is connected between the auxiliary motor and the dipping and metering rollers. The torque transmission device does not include a rigid rotary connection apparatus for driving the dipping roller and the metering roller.

19 Claims, 2 Drawing Sheets

DRIVE MECHANISM FOR A PRINTED SHEET VARNISHING DEVICE OF A PRINTING MACHINE

BACKGROUND OF THE INVENTION

1. Field of the Invention

The present invention relates to a device for varnishing printed sheets in a printing machine, or printing press. The printing machine includes a varnish pan, a dipping roller and a metering roller for transferring varnish onto a varnishing cylinder. The dipping roller and the metering roller include a drive mechanism that can be connected to the machine drive by an overrunning clutch. The printing press also includes an auxiliary motor through which the dipping roller and the metering roller can be driven, even when the machine is at a standstill. The auxiliary motor is connected to the dipping roller and/or the metering roller through a torque transmitting device that does not include a rigid, rotary connection therein.

2. Background Information

Printing presses in which the present invention may be employed are well known. U.S. Pat. application Ser. No. 07/482,260, which is now allowed and which will issue as U.S. Pat. No. 5,010,820 on Apr. 30, 1991, discloses one such printing press.

Printing machine, or printing press, varnishing units are disclosed in German Patent Publication Number 33 24 096 C2. Also, a drive of a varnishing unit that can be connected to the machine drive of a printing press through an overrunning clutch is disclosed in German Patent Publication Number 36 38 469 A1. This disclosed device provides an auxiliary motor for driving the dipping roller and the metering roller when the machine is at a standstill.

Also, German Patent Publication Number 36 38 469 A1 discloses an electromagnetic clutch through which a dipping roller and a metering roller are driven and rotated by an electromotor when the machine is at a standstill to prevent the varnish from drying up on the rollers. A rigid drive mechanism for the rollers is not needed in the device disclosed in this patent publication. However, the electromagnetic clutch mechanism and its switching apparatus disclosed in this patent publication are expensive and not very economical to construct and/or operate.

OBJECT OF THE INVENTION

One object of the present invention is to provide a varnishing device having a drive that properly functions to rotate the varnish rollers even when the printing machine is at a standstill. Another object of the present invention is to provide an optimally adjusted machine meeting desired technical requirements but not requiring great technical efforts to construct and/or operate.

SUMMARY OF THE INVENTION

The present invention achieves these objects by providing an auxiliary motor that is connected to the dipping roller and/or the metering roller of a printing press varnishing unit for rotation of those rollers in both directions of rotation. The rollers are connected to the auxiliary motor through a torque transmitting device, such as those employing permanent magnets but not employing a rigid, rotary connection therein. With the present invention, simple devices may be employed that do not require switching means. Due to the absence of a rigid, rotary connection in the torque transmitting device, the switching phases of the auxiliary motor can be selected arbitrarily. In other words, the auxiliary motor does not have to be switched off when the main drive of the printing press rotates the rollers since the absence of a rigid connection in the torque transmitting device allows the auxiliary motor to operate at a different speed from that of the rollers, even when the press drive is rotating the rollers.

In one embodiment of the present invention, the torque transmitting device includes an annular permanent magnet that is separated into two halves. One half of the magnet is fastened to a gearwheel that is driven by the auxiliary motor. The other half of the magnet is fastened to a flange that is connected to the journal of either the dipping roller or the metering roller. The auxiliary motor drives both rollers at low speed when the rollers are not being driven by the machine drive of the printing press. When being driven by the auxiliary motor, adequate torque is transmitted by the annular permanent magnet of the torque transmitting device, to the two rollers so that the rollers are easily driven at low speed. The annular permanent magnet may be formed of annularly arranged, single magnets. In accordance with the present invention, the machine does not require any switching means, such as switching means for the auxiliary motor. Moreover, such a permanent magnet torque transmitting device is, generally, maintenance free and is not subjected to wear and tear so that the drive can be constructed and used at low cost. If, for example, a slip clutch were employed instead of an annular permanent magnet torque transmitting device, maintenance costs would be somewhat higher.

In summary, one feature of the invention resides broadly in an offset printing machine comprising: an ink distribution system; ink roller means for receiving ink from the ink distribution system and applying the ink to sheets; damping means for supplying damping medium to the ink roller means; varnishing means for applying varnish to printed sheets; and control means for controlling the ink distribution system, the ink roller means, the damping means and the varnishing means. The varnishing means comprises: a varnish metering roller; motor means for rotating the varnish metering roller; torque transmission means for connecting the motor means to the varnish metering roller; the torque transmission means including a first torque transmission part for being connected to the motor means; the torque transmission means including a second torque transmission part for being connected to the varnish metering roller; the first torque transmission part and the second torque transmission part each being configured and relatively positioned with respect to one another such that the motor means and the first torque transmission part provide rotational power to the second torque transmission part and the varnish metering roller and dipping roller; and the first torque transmission part being out of contact with the second torque transmission part such that the first torque transmission part can rotate independently of the second torque transmission part.

BRIEF DESCRIPTION OF THE DRAWINGS

The following Description of the Preferred Embodiments may be better understood when taken in conjunction with the appended drawings in which.

DESCRIPTION OF THE PREFERRED EMBODIMENTS

Figure 1:
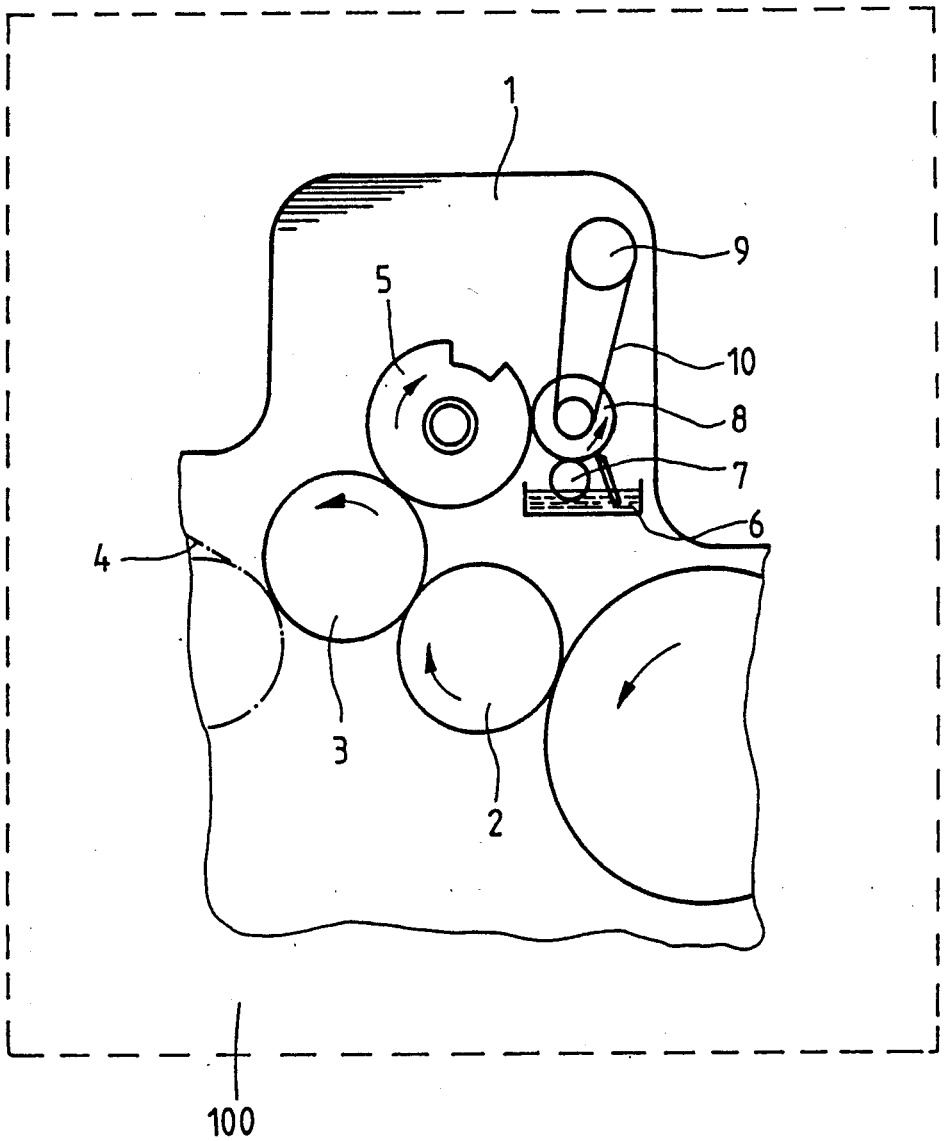
FIG. 1 is a side elevational view of a portion of a varnishing unit that employs the present invention.

As shown in FIG. 1, varnishing unit 1 of printing press 100, is employed to apply varnish to sheets of paper (not shown). The sheets to be varnished are transferred by transfer drum 2 to impression cylinder 3 and, thereafter, conveyed to a delivery pile (not shown) by chain delivery device 4.

Impression cylinder 3 varnishes the sheets by varnish supplied from varnishing cylinder 5. To accomplish such varnishing, a blanket (not shown) may be mounted on varnishing cylinder 5. Additionally, varnish pan 6, dipping roller 7 and metering roller 8 are provided to transfer the varnish from varnish pan 6 onto varnishing cylinder 5. In the embodiment of the invention illustrated in FIG. 1, auxiliary motor 9 drives toothed belt 10. Toothed belt 10, in turn, is employed to drive dipping roller 7 and metering roller 8 when the machine is at standstill as described below.

Figure 2:
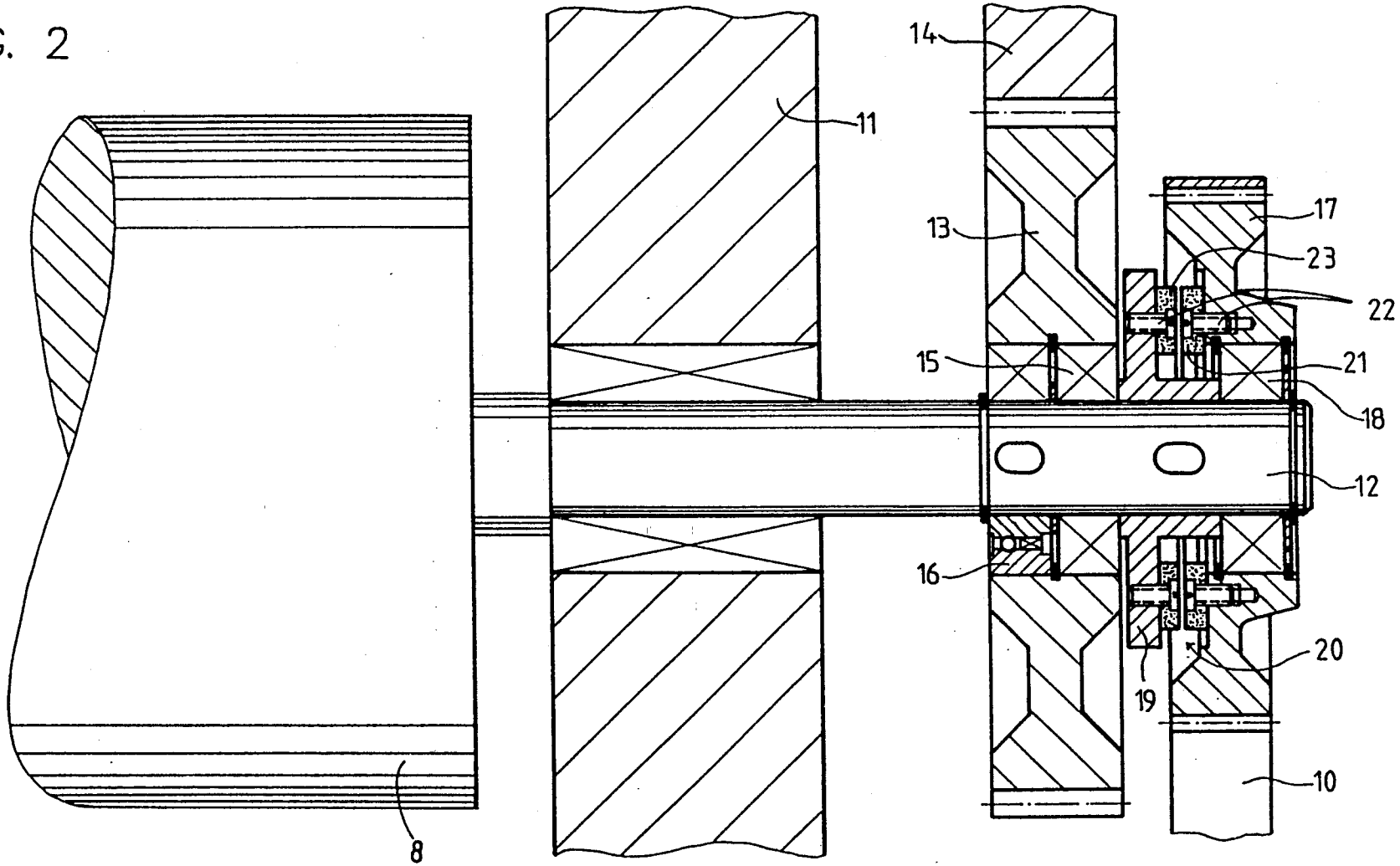
FIG. 2 is a partial sectional view through a varnishing unit that employs the present invention.

FIG. 2 shows metering roller 8 that is pivot mounted in machine side frame 11. Gearwheel 13, which meshes with gearwheel 14 of the printing machine drive, is mounted on journal 12. Gearwheel 13 is mounted on journal 12 by rolling bearing 15 and overrunning clutch 16 so that roller 8, and thus roller 7, can be driven by the printing machine drive. Clutch 16 may disengage gearwheels 13 and 14 from roller 8 when the printing machine drive is at a standstill so that motor 9, through toothed belt 10, can drive rollers 7 and 8.

Gearwheel 17 is pivotally mounted on journal 12 by rolling bearing 18. Gearwheel 17 may be driven by toothed belt 10 and, thus, auxiliary motor 9. The torque transmitting device, of the present invention comprises annular permanent magnet 20. Annular permanent magnet 20 comprises permanent magnet halves 21 and 23. Annular permanent magnet 20 is positioned between gearwheel 17 and flange 19. Annular permanent magnet 20 may comprise a magnetic clutch. Flange 19 is rigidly fastened to journal 12. Permanent magnet halves 21 and 23 are fastened to gearwheel 17 and flange 19, respectively, by screws 22. A small gap is provided between magnet halves 21 and 23. Therefore, there is no rigid connection between magnet half 21 and magnet half 23. Annular permanent magnet 20 transmits sufficient torque for rotating flange 19, journal 12 and metering roller 8 at low speed when magnet half 21 is rotated by auxiliary motor 9 and the machine drive is disconnected from journal 12, such as when the machine is at a standstill. Magnet half 21 applies a magnetic force to magnet half 23 such that magnet half 23 rotates with the rotation of magnet half 21. Magnet half 23, in turn, rotates flange 19, journal 12 and metering roller 8. In other words, the magnetic field from magnet half 21 interacts with the magnetic field from magnet half 23. The interaction of the magnetic fields causes magnet half 21 to apply a magnetic force to magnet half 23. Therefore, magnet half 23 rotates with magnet half 21. Thus, when magnet half 21 is rotated by motor 9, magnet half 23, flange 19, journal 12 and thus rollers 7 and 8, are likewise rotated. A drive mechanism is connected between rollers 7 and 8 so that roller 8 can drive roller 7. For example, as shown in FIG. 1, the mutual contact between rollers 7 and 8 may allow roller 8 to drive roller 7 by the frictional contact therebetween.

In another embodiment of the invention, journal 12 may be directly connected to, and directly drive dipping roller 7 rather than metering roller 8. In this embodiment, therefore, the drive mechanism would then be configured such that roller 7 would drive roller 8.

Auxiliary motor 9 can continue to run without any switching actions having to be taken, such as when the printing machine temporarily accelerates, due to the absence if a rigid rotary connection between magnet halves 21 and 23. In other words, auxiliary motor 9 does not have to be shut off when the printing machine drive accelerates and/or rotates rollers 7 and 8 since magnet halves 21 and 23 are not rigidly connected to one another and can, therefore, rotate independently and at different speeds.

Thus, it may be appreciated that the present invention provides an effective device for rotating rollers 7 and 8, even when the printing press is at a standstill since the torque transmitting device comprising magnet 20 effectively transmit torque from auxiliary motor 9 to rollers 7 and 8, even though the torque transmitting device does not employ a rigid connection between its mechanical power input device (magnet half 21) and its mechanical power output device (magnet half 23).

One feature of the invention resides broadly in a device for varnishing printed sheets in a printing machine comprising a varnish pan, a dipping roller and a metering roller for transferring the varnish onto a varnishing cylinder, said dipping roller and said metering roller having a drive which can be connected to the machine drive via an overrunning clutch, and comprising an auxiliary motor via which said dipping roller and said metering roller can be driven at a standstill of the machine, characterized in that said auxiliary motor 9 is connected to the drive of said dipping roller 7 and said metering roller 8 in both directions of rotations via a torque transmitting means, doing without a rigid rotary connection.

Another feature of the invention resides broadly in a device characterized in that said torque transmitting means is designed as an annular permanent magnet 20, one half 21 of said permanent magnet being fastened to a gearwheel 17 which is driven by said auxiliary motor 9, and the other half 23 of said permanent magnet being fastened to a flange 19 which is connected to a journal 12 of said dipping roller 7 and said metering roller 8, said auxiliary motor 9 driving both roller 7, 8 at low speed.

Yet another feature of the invention resides broadly in a device characterized in that said annular permanent magnet 20 is formed of single magnets which are annularly arranged in order to transmit torques.

Patents relating to clutches include U.S Pat. No. 5,002,235, entitled "Roll Lift and Drive Assembly"; U.S. Pat. No. 4,899,655, entitled "Driving System for a Rotary Press"; U.S. Pat. No. 4,836,112, entitled "Hydraulic Inching Drive System"; U.S. Pat. No. 4,453,464, entitled "Printing Presses"; U.S. Pat. No. 4,527,477, entitled "Ink Metering Device"; U.S. Pat. No. 4,397,236, entitled "Inking Unit with Traversing Ink Rollers";

U.S. Pat. No. 4,218,972, entitled "Switching Apparatus Between Printing Modes in Printing Cylinders of Rotary Press"; and U.S. Pat. No. 4,183,296, entitled "Drive System for Sheet-Fed Rotary Printing Presses with Tandem..Mounted Printing Units."

Patents relating to magnetic clutches include U.S. Pat. No. 4,825,992, entitled "Magnetic Torque Limiting Clutch Having Overload Disconnection Means"; U.S. Pat. No. 4,811,823, entitled "Magnetic Particle Clutch"; U.S. Pat. No. 4,803,628, entitled "Method and Apparatus for Controlling Electro-Magnetic Particle Clutch"; U.S. Pat. No. 4,775,291, entitled "Magnetic Clutch Drive and Thrust Balancing Mechanism for Rotary Pumps"; U.S. Pat. No. 4,520,914, entitled "Centrifugal Clutch With Radially Movable Magnetic Member"; U.S. Pat. No. 4,494,639, entitled " Electro-magnetic Clutch Control System for Automobiles; and U.S. Pat. No. 5,002,235, entitled "Roll Lift and Drive Assembly."

Patents relating to varnishing units and/or printing presses include U.S. Pat. No. 4,813,356, entitled "Clamping Device for Optionally Securing a Blanket or a Printing Plate"; U.S. Pat. No. 4,567,823, entitled "Arrangement on Multi-color Rotary Presses for Application of Liquids to a Printing Unit Cylinder"; U.S Pat. No. 4,495,863, entitled "Arrangement for Prevention of Roller Marks on Roller Units in a Printing Press"; U.S. Pat. No. 4,480,548, entitled "Device for Varnishing Systems to Prevent Varnish Drying In Out of Paper Size Side Zones of Roller"; U.S. Pat. No. 4,399,767, entitled "Varnishing Unit in the Delivery Unit of a Sheet-fed Rotary Printing Press"; and U.S. Pat. No. 4,369,734, entitled "Varnishing Assembly in a Printing Press Having Self-Cleaning Feature."

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. An offset printing machine comprising:

an ink distribution system;

ink roller means for receiving ink from said ink distribution system and applying the ink to sheets;

damping means for supplying damping medium to said ink roller means;

varnishing means for applying varnish to printed sheets; and control means for controlling said ink distribution system, said ink roller means, said damping means and said varnishing means;

said varnishing means comprising:

a varnish metering roller;

a varnish dipping roller;

motor means for rotating said varnish metering roller and said varnish dipping roller;

torque transmission means for connecting said motor means to said varnish metering roller and said varnish dipping roller;

said torque transmission means including a first torque transmission part for being connected to said motor means;

said torque transmission means further including a second torque transmission part for being connected to said varnish metering roller and said varnish dipping roller;

said first torque transmission part and said second torque transmission part each being configured and relatively positioned with respect to one another such that said motor means and said first torque transmission part provide rotational power to said second torque transmission part, said varnish metering roller, and said varnish dipping roller;

said first torque transmission part being out of contact with said second torque transmission part such that said first torque transmission part can rotate independently of said second torque transmission part;

mechanical clutch means for mechanically connecting a printing press drive to said varnish metering roller and said varnish dipping roller;

said mechanical clutch means and the printing press drive being for rotating said varnish metering roller and said varnish dipping roller;

said non-contacting torque transmission means for continuously transmitting torque between said first torque transmission part and said second torque transmission part;

wherein said mechanical clutch means overruns said non-contacting torque transmission means when said press drive is engaged with said varnishing meter roller and said varnishing dipping roller.

2. The offset printing machine of claim 1, wherein said first torque transmission part and said second torque transmission part each comprise a permanent magnet.

3. The offset printing machine of claim 2, wherein at least one said permanent magnet is formed in an at least partially annular configuration.

4. The offset printing machine of claim 1, wherein:

one of said varnish metering roller and said varnish dipping roller comprises shaft means for being connected to said torque transmission means and said mechanical clutch means to rotate said varnish metering roller and said varnish dipping roller; and both of said torque transmission means and said mechanical clutch means are disposed on said shaft means.

5. The offset printing machine of claim 4, wherein said second torque transmission part is configured to rotate at one of:

a) substantially the same speed as said first torque transmission part when said mechanical clutch means and the printing press drive do not rotate said varnish metering roller and said varnish dipping roller, and b) a different speed from said first torque transmission part when said mechanical clutch means and the printing press drive rotate said varnish metering roller and said varnish dipping roller.

6. A varnishing device for a printing press comprising:

a varnish metering roller;

a varnish dipping roller;

motor means for rotating said varnish metering roller and said varnish dipping roller;

torque transmission means for connecting said motor means to said varnish metering roller and said varnish dipping roller;

said torque transmission means including a first torque transmission part for being connected to said motor means;

said torque transmission means further including a second torque transmission part for being connected to said varnish metering roller and said varnish dipping roller;

said first torque transmission part and said second torque transmission part each being configured and relatively positioned with respect to one another such that said motor means and said first torque transmission part provide rotational power to said second torque transmission part, said varnish metering roller, and said varnish dipping roller;

said first torque transmission part being out of contact with said second torque transmission part such that said first torque transmission part can rotate independently of said second torque transmission part;

mechanical clutch means for mechanically connecting a printing press drive to said varnish metering roller and said varnish dipping roller;

said mechanical clutch means and the printing press drive being for rotating said varnish metering roller and said varnish dipping roller;

said non-contacting torque transmission means for continuously transmitting torque between said first torque transmission part and said second torque transmission part; wherein said mechanical clutch means overruns said non-contacting torque transmission means when said press drive is engaged with said varnishing meter roller and said varnishing dipping roller.

7. The device of claim 6, wherein said first torque transmission part and said second torque transmission part each are constructed of magnetic material.

8. The device of claim 7, wherein:

said first torque transmission part and said second torque transmission part are relatively positioned such that said first torque transmission part applies a magnetic force to said second torque transmission part; and said first torque transmission part rotates said second torque transmission part by said magnetic force when said first torque transmission part is rotated by said motor means.

9. The device of claim 8, wherein said magnetic material of said first torque transmission part and said second torque transmission part each comprise a permanent magnet.

10. The device of claim 9, wherein at least one said permanent magnet is formed in an at least partially annular configuration.

11. The device of claim 6, wherein:

one of said varnish metering roller and said varnish dipping roller comprises shaft means for being connected to said torque transmission means and said mechanical clutch means to rotate said varnish metering roller and said varnish dipping roller; and both of said torque transmission means and said mechanical clutch means are disposed on said shaft means.

12. The device of claim 11, wherein said second torque transmission part is configured to rotate at one of:

a) substantially the same speed as said first torque transmission part when said mechanical clutch means and the printing press drive do not rotate said varnish metering roller and said varnish dipping roller, and b) a different speed from said first torque transmission part when said mechanical clutch means and the printing press drive rotate said varnish metering roller and said varnish dipping roller.

13. A varnishing device for an offset printing machine comprising:

a varnish dipping roller;

a varnish metering roller;

motor means for rotating said varnish dipping roller and said varnish metering roller;

torque transmission means for connecting said motor means to said varnish dipping roller and said varnish metering roller;

said torque transmission means including a first torque transmission part for being connected to said motor means;

said torque transmission means further including a second torque transmission part for being connected to said varnish dipping roller and said varnish metering roller;

said first torque transmission part and said second torque transmission part each being configured and relatively positioned with respect to one another such that said motor means and said first torque transmission part provide rotational power to said second torque transmission part, said varnish dipping roller, and said varnish metering roller;

said first torque transmission part being out of contact with said second torque transmission part such that said first torque transmission part can rotate independently relative to said second torque transmission part;

mechanical clutch means for mechanically connecting a printing machine drive to said varnish metering roller and said varnish dipping roller;

said mechanical clutch means and the printing press drive being for rotating said varnish metering roller and said varnish dipping roller;

said non-contacting torque transmission means for continuously transmitting torque between said first torque transmission part and said second torque transmission part; wherein said mechanical clutch means overruns said non-contacting torque transmission means when said press drive is engaged with said varnishing meter roller and said varnishing dipping roller.

14. The device of claim 13, wherein said first torque transmission part and said second torque transmission part each are constructed of magnetic material.

15. The device of claim 14, wherein:

said first torque transmission part and said second torque transmission part are relatively positioned such that said first torque transmission part applies a magnetic force to said second torque transmission part; and said first torque transmission part rotates said second torque transmission part by said magnetic force when said first torque transmission part is rotated by said motor means.

16. The device of claim 15, wherein said magnetic material of said first torque transmission part and said second torque transmission part each comprise a permanent magnet.

17. The device of claim 16, wherein at least one said permanent magnet is formed in an at least partially annular configuration.

18. The device of claim 13, wherein:

one of said varnish metering roller and said varnish dipping roller comprises shaft means for being connected to said torque transmission means and said mechanical clutch means to rotate said varnish metering roller and said varnish dipping roller; and both of said torque transmission means and said mechanical clutch means are disposed on said shaft means.

19. The device of claim 18, wherein said second torque transmission part is configured to rotate at one of:

a) substantially the same speed as said first torque transmission part when said mechanical clutch means and the printing press drive do not rotate said varnish metering roller and said varnish dipping roller, and b) a different speed from said first torque transmission part when said mechanical clutch means and the printing press drive rotate said varnish dipping roller and said varnish metering roller.

* * * * *

UNITED STATES PATENT AND TRADEMARK OFFICE

CERTIFICATE OF CORRECTION

PATENT NO. : 5,192,367

DATED : March 9, 1993

INVENTOR(S) : Günther HOFMANN

It is certified that error appears in the above-identified patent and that said Letters Patent is hereby corrected as shown below:

column 2, line 59, after the first occurrence of 'roller', delete "and dipping roller".

Signed and Sealed this

Seventh Day of June, 1994

*Attest:*

Bruce Lehman

BRUCE LEHMAN

*Attesting Officer*

*Commissioner of Patents and Trademarks*